United States Patent [19]

Fogal et al.

[11] Patent Number: 4,470,353

[45] Date of Patent: Sep. 11, 1984

[54] STEM BOOSTER

[75] Inventors: Richard F. Fogal; W. Keith Gallant, both of Hennepin County, Minn.

[73] Assignee: Honeywell Inc., Minneapolis, Minn.

[21] Appl. No.: 402,001

[22] Filed: Jul. 26, 1982

[51] Int. Cl.[3] ..... F42B 1/02

[52] U.S. Cl. ..... 102/476

[58] Field of Search ..... 102/476, 306, 307, 475, 102/701

[56] References Cited

U.S. PATENT DOCUMENTS 2,697,400 12/1954 Liliegren ..... 102/476
2,717,552 9/1955 Brandt ..... 102/476
2,764,092 9/1956 Massey ..... 102/476
3,580,174 5/1971 Apotheloz et al. ..... 102/476

FOREIGN PATENT DOCUMENTS 2841056 11/1982 Fed. Rep. of Germany .

*Primary Examiner*—Harold J. Tudor
*Assistant Examiner*—Ted L. Parr
*Attorney, Agent, or Firm*—George W. Field

[57] ABSTRACT

The method of preventing improper functioning of an armor piercing projectile having an axial hollow liner around which the explosive of the projectile is consolidated which comprises consolidating an axial pellet of explosive into the rearward portion of said liner.

1 Claim, 1 Drawing Figure

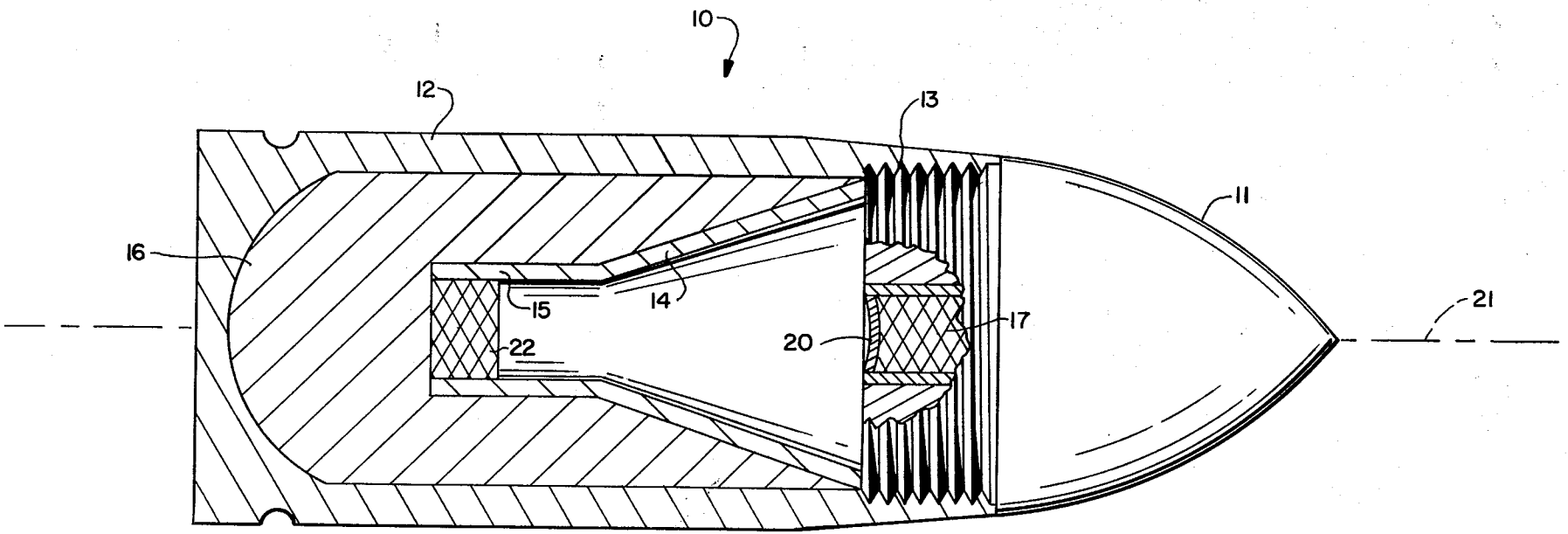
10
11
12
13
14
15
16
17
20
21
22

STEM BOOSTER

The Government has rights in this invention pursuant to Contract No. DAAK10-78-C-0408 awarded by the Department of the Army.

TECHNICAL FIELD

This invention relates to the field of munitions, and more particularly to improvements in high explosive dual purpose rounds for use in guns in the range of 40 mm or less.

BACKGROUND OF THE INVENTION

In the projectiles of such rounds a forward fuse functions on contact with a target to fire a charge of a high explosive in the rearward casing of the projectile. The explosive is consolidated about a rearwardly tapering hollow metal liner, and is fired by a mass moving rearwardly at high velocity to impact the explosive and produce a detonation wave acting forwardly and outwardly from a point on the axis of the projectile.

It has been found that the moving mass does not always impact the explosive axially, so that the detonation wave is not optimally positioned on the axis, and imperfect firing of the projectile results.

BRIEF SUMMARY OF THE INVENTION

According to the present invention a pellet explosive is consolidated into the neck of the liner against the main explosive, to act as the center for initiation of the detonation wave by the principal explosive.

Various advantages and features of novelty which characterize the invention are pointed out with particularity in the claims annexed hereto and forming a part hereof. However, for a better understanding of the invention, its advantages, and objects attained by its use, reference should be had to the drawing which forms a further part hereof, and to the accompanying descriptive matter, in which there is illustrated and described a preferred embodiment of the invention.

The single FIGURE of the drawing is a schematic showing in longitudinal section of a projectile embodying the invention.

DESCRIPTION OF THE PREFERRED EMBODIMENT

A high explosive dual purpose projectile 10 comprises a forward fuse 11 and rearward casing 12 for high explosives, which may be interconnected by screw threads 13. Conventionally, the casing 12 contains a hollow conical metal liner 14 which tapers rearwardly to a neck 15, and the high explosive 16 of the projectile is consolidated about the liner. Fuze 11 includes a lead explosive 17 set off by a suitable detonator not shown, which converts a metal closure 20 to a mass moving at high velocity rearward along the axis 21 of the projectile, passing through liner 14 and impinging on explosive 16 at the end of neck 15, and so initiating a detonation wave which functions first to convert liner 14 to a jet of molten metal moving forwardly at a high velocity as an armor piercing weapon, and second to fragment casing 12 as an antipersonnel weapon.

It has been found that mass 20 does not always impact explosive 16 on axis 21, and the resulting detonation wave does not form properly. The fragmentation of casing 12 occurs, but the conversion of liner 14 to a jet is irregular, and may indeed result in a pair of jets neither of which is the necessary strength for its intended purpose.

According to the present invention, a booster pellet 22 of explosive is consolidated into the neck 15 of liner 14, to be impacted by mass 20 when lead explosive 17 is fired. This ensures that the detonation wave from the high explosive 16 will in fact emanate from a center on axis 21, and will accordingly act symetrically on liner 14 to convert it to the desired single, properly directed jet.

From the above it will be evident that the invention comprises an improved projectile in which a booster pellet of explosive is consolidated in the neck of a liner consolidated into the principal high explosive, so that upon firing of a fuse the resulting detonation wave emanates from a center accurately on the projectile axis, to produce a powerfully directed single jet of high velocity liquid metal.

Numerous characteristics and advantages of the invention have been set forth in the foregoing description, together with details of the structure and function of the invention, and the novel features thereof are pointed out in the appended claims. The disclosure, however, is illustrative only, and changes may be made in detail, especially in matters of shape, size, and arrangement of parts, within the principle of the invention, to the full extent indicated by the broad general meaning of the terms in which the appended claims are expressed.

The embodiments of the invention in which an exclusive property or right is claimed are defined as follows:

1. In a projectile having a longitudinal axis extending rearwardly from a forward end;

a fuze at said forward end of said projectile for impelling a high velocity mass rearwardly along said axis;

a chamber for explosive at the rearward end of said projectile;

a unitary hollow metal liner positioned on the axis at the forward end of said chamber, said liner tapering rearwardly to a narrow neck;

a charge of explosive material consolidated in said chamber about said liner; and an explosive pellet in said narrow neck in contact with said explosive material at the axis as well as at all other points in a plane perpendicular to the longitudinal axis within the inside diameter of the neck of said liner, so that in practice said high velocity mass with said pellet initiates detonation thereof which is communicated to said charger material, resulting in a forward moving detonation wave centered on said axis which converts said liner to a forward moving jet of liquid metal.

* * * * *